US010335350B1

(12) United States Patent
Khodadadi

(10) Patent No.: US 10,335,350 B1
(45) Date of Patent: Jul. 2, 2019

(54) PACIFIER WHICH HELPS WEAN TODDLERS OFF PACIFIERS

(71) Applicant: Soheil Khodadadi, Beverly Hills, CA (US)

(72) Inventor: Soheil Khodadadi, Beverly Hills, CA (US)

( * ) Notice: Subject to any disclaimer, the term of this patent is extended or adjusted under 35 U.S.C. 154(b) by 34 days.

(21) Appl. No.: 14/700,004

(22) Filed: Apr. 29, 2015

(51) Int. Cl.

| | |
|---|---|
| ***A46B 9/04*** | (2006.01) |
| ***A46B 15/00*** | (2006.01) |
| ***A61J 17/00*** | (2006.01) |
| ***A61J 11/00*** | (2006.01) |

(52) U.S. Cl.
CPC ..... *A61J 17/001* (2015.05); *A46B 9/04* (2013.01); *A46B 15/0055* (2013.01); *A61J 11/0035* (2013.01)

(58) Field of Classification Search
CPC ..... A61J 17/001; A61J 17/006; A61J 7/0053; A61J 17/02; A61J 17/008; A61J 17/007; A61J 2200/44; A61J 2200/76; A61J 7/0046; A61J 11/007; A61J 11/04; A61J 11/0005; A61J 11/0055; A61J 11/0065; A61J 11/00; A61J 11/008; A61J 2205/20; A61J 9/00; A61J 9/0607; A61J 9/0684; A46B 15/0055; A46B 2200/1066; A46B 5/04; A46D 1/0207
See application file for complete search history.

(56) References Cited

U.S. PATENT DOCUMENTS

2017/0151131 A1* 6/2017 Bawa ..... A61J 17/001

* cited by examiner

*Primary Examiner* — David C Eastwood
*Assistant Examiner* — Mohamed G Gabr
(74) *Attorney, Agent, or Firm* — Joseph Yanny

(57) ABSTRACT

A new and improved pacifier provides bristle like structures which discourages continued use of the pacifier by a child of appropriate age.

6 Claims, 2 Drawing Sheets

PACIFIER WHICH HELPS WEAN TODDLERS OFF PACIFIERS

BACKGROUND OF THE INVENTION

1. Field of the Invention

Infants have an intense need to suck that is separate from their need to eat. Fetuses may suck their thumbs before they are born, and some newborns begin to suck immediately. Infants suck when they are tired, bored, or in need of comfort. Some babies have a stronger need to suck than others and—next eating and being held—sucking may provide the most comfort to an infant. Babies who do not suck their thumbs or fingers often rely on pacifiers. A pacifier is an artificial nipple designed for babies to suck on for comfort. The present invention relates to a unique type of pacifier which makes it easier to break the baby of the habit of using a pacifier with minimal psychological impact.

Early pacifiers were manufactured with a choice of black, maroon or white rubber, though the white rubber of the day contained a certain amount of lead. Binky (with a "y") was first used in about 1935 as a trademarked brand name for pacifiers and other baby products manufactured by the Binky Baby Products Company of New York. The brand name is currently owned by Playtex Products, LLC as a trademark in the U.S. (and a number of other countries).

In Western societies 75 to 85 percent use pacifiers. Hospital nurseries commonly give them to newborns. Premature infants seem to grow when they suck on pacifiers. Professionals refer to a pacifier as a transitional object that helps children adjust to new situations and relieve stress.

Most infants cry because they do not yet have methods for soothing themselves. Some newborns do not have the coordination to suck their fingers or thumb. Although breastfeeding is the most effective way to calm infants, and their hands or thumbs can be placed in their mouths, pacifiers can be very helpful for discontented babies who cannot or will not suck their thumbs or fingers.

2. Description of the Prior Art

A pacifier (American and Canadian English), dummy (Britian, and other Commonwealth countries), binky, or soother (in other countries) is a rubber, plastic, or silicone nipple given to an infant or other young child to suck upon. In its standard appearance it has a teat, mouth shield, and handle. The mouth shield and/or the handle is large enough to avoid the danger of the child choking on it or swallowing it.

Pacifiers were cited for the first time in medical literature in 1473, being described by German physician Bartholomaus Metlinger in his book Kinderbuchlein, retitled on later editions as Regiment der jungen Kinder ("A Guide on Young Children").

Pacifiers were settling into their modern form around 1900 when the first teat, shield and handle design was patented in the US as a "baby comforter" by Manhattan pharmacist Christian W. Meinecke. Rubber had been used in flexible teethers sold as "elastic gum rings" for British babies in the mid-19$^{th}$ century, and also used for feeding-bottle teats. In 1902, Sears, Roebuck & Co. advertised a "new style rubber teething ring, with one hard and one soft nipple". And in 1909, someone calling herself "Auntie Pacifier" wrote to the New York Times to warn of the "menace to health" (she meant dental health) of "the persistent, and, among poorer classes, the universal sucking of a rubber nipple sold as a 'pacifier'. In England too, dummies were seen as something the "poorer classes" would use, and associated with poor hygiene. In 1914, a London doctor complained about "the dummy teat": "If it falls on the floor it is rubbed momentarily on the mother's blouse or apron, lipped by the mother and replaced in the babies mouth."

Pacifiers consists of a latex or silicone nipple with a firm plastic shield and handle. Latex pacifiers are softer or more flexible but wear out faster than silicone. Silicone pacifiers are firmer, hold their shapes longer, and are easier to clean. The nipple should be knotted around the back of the handle and the shield and handle should be one piece. This prevents the nipple from falling off or the plastic from breaking in two and posing a choking hazard. The shield should be at least 1.5 inches (6 cm) across so that it will not fit in the babies mouth. The shield should have air holes or vents to prevent saliva from collecting behind it and causing an irritation or rash. Large circular shields can obstruct an intensely sucking baby's nasal passages. Pacifiers should have easy-to-hold handles, be dishwasher-safe, and easy to clean.

Pacifiers come in several sizes designed for premature infants, newborns, babies young than six months, and children older than six months. Pacifier nipples come in various shapes—long, short, flattened, or with a ball-shaped end. Some are shaped like bottle nipples and others resemble a breast nipple that is being sucked on. The latter may not always fit a baby's mouth. There is no evidence that one shape is preferable to another, although the baby may prefer a certain type. Some babies gag at the texture, taste, or smell of some pacifiers. A baby bottle nipple should never be used as a pacifier since the nipple could pop out of the ring and choke the baby.

Pacifiers are sometimes attached to a baby's clothing with a clip and a short cord or ribbon to prevent them from becoming lost or dirty. However a child can become entangled in even a short cord and should never be put to bed with a pacifier attached to a cord. A pacifier that is hung on a cord around the baby's neck, tied to the baby's hand, or attached to a crib can cause strangulation. Pacifiers should never be sweetened because sweetened pacifiers constitute a leading cause of tooth decay in babies under age three.

Pacifiers never should be used to replace a feeding, and children should never be given a pacifier if they are hungry. A hungry baby may become upset when there is no milk in the nipple and could develop feeding problems. Thus pacifiers should only be used between or after feedings.

Pacifier use is controversial. Some physicians are completely opposed to pacifier use, whereas others view pacifiers as helpful if used in moderation. Pacifiers can be particularly useful for unhappy babies who are difficult to comfort. The child's energy goes into sucking on a pacifier rather than crying. Although pacifiers can give children a sense of calm and security well into their toddler years, pacifier use may be most effective during the first few months of life when fussiness, colic, and the need to suck are at their peaks.

Pacifiers should only be used to satisfy the need to suck. They should never be used to delay or replace nurturing or feeding. As a child grows, a use of pacifier should be stopped.

For babies, pacifiers can be used for the following reasons: to sooth a baby to sleep; to help a baby to stay asleep when disturbed; to calm a frightened baby; and to keep the baby quiet. However, the World Health Organization recommends against pacifier use. The list of pacifier use may include: they may get dirty and thus contribute to poor hygiene;

if lost during sleep, the pacifier's absence may cause the baby to wake up and cry;

the pacifier may prevent babies from using their mouths to learn about toys and other objects; the pacifier may signal to a baby that crying is unacceptable even though crying is one of a baby's few means of communication;

the pacifier is an easy fix that may cause parents not to seek to understand what is bothering the baby; pacifiers may prevent children from learning how to comfort themselves;

older siblings may give the baby a pacifier to quiet a baby in situations where the parents would not use it; and many adults dislike the sight of babies with pacifiers.

Additionally, pacifiers should never be given to breastfeeding infant unless an efficient nursing routine is well-established. Pacifiers may cause nipple confusion. Newborns must learn to breastfeed effectively, and babies suck on breast nipples differently than on a pacifier. Pacifiers have a narrow base so that infants do not have to open their lips widely. Pacifier use may prevent infants from learning how to latch onto their mother's breast, resulting in poor feedings and sore nipples.

A number of studies have found that frequent pacifier use reduces duration of breastfeeding and increases the likelihood that a baby will be weaned by six months. The earlier a pacifier is introduced the sooner breastfeeding ceases. The reasons for this include the following: pacifier use causes babies to breastfeed less; mothers may introduce a pacifier because they want to stop breastfeeding; infants who are given a pacifier, with or without supplemental food, may lose interest in nursing; a reduction in breastfeeding decreases the mother's milk production; a reduction in nipple stimulation by a nursing infant decreases milk production; and ear infections.

Research has found that pacifier use increases a child's risk of ear infections—acute otitis media, the second most common childhood illness after colds. In one study pacifier use increased the frequency of ear infections by 50 percent. Another study found a 33 percent decreases in ear infections when pacifier use was limited to babies aged six to ten months and only used when they were falling asleep. It may be that pacifier use spreads infection or that intense sucking on pacifiers hinders proper functioning of the eustachian tube that normally keeps the middle ear open and clean. The studies suggest that pacifiers only be used with babies under ten months of age, when the need to suck is the strongest and the incidence of ear infection is relatively low.

Another serious concern about prolonged pacifier use is dental problems. Both dental cavities and misaligned teeth have long been associated with pacifier use. If pacifier and thumb sucking continued past about age three, both can contribute to protruding front teeth and an overbite. Orthodontic pacifiers do not prevent dental abnormalities. Many dentists believe that neither pacifier use nor thumb sucking should continue once all of the baby teeth have erupted. A dentist may recommend devices that are designed to discourage pacifier use.

Additionally, pacifiers can exacerbate any problems with developing speech and language. They have been shown to interfere with normal babbling and speech development in babies older than 12 months. A child learning to speak with a pacifier may have distorted speech. The child may replace "t" and "d" sounds—that require the front of the tongue to brush against the teeth—with "k" and "g" sounds that come from the back of the throat. Pacifiers also can interfere with children's willingness to talk and the development of their social skills.

Some research has suggested that babies exhibit fewer visually exploratory behaviors when using a pacifier; they look around less and can seem less alert. Some of these children receive less of the following: mental stimulation; encouragement to explore and learn; and parental attention.

Additional risks of pacifier use include the following: the transmission of thrush, a yeast infection, that can be difficult to eradicate in children with pacifiers; product recall of pacifiers due to safety concerns; and children who are unable to give them up even after years of use.

Research also suggests that infants who use pacifiers may have more ear infections (otitis media). It is not clear, though, whether avoiding the use of a pacifier can prevent ear infections. It is also commonly believed that using a pacifier will lead to dental problems. However if the pacifier is used for less than around three years, it does not appear to lead to long-term damage.

Researchers have found that use of a pacifier is associated with a substantial reduction in the risk of SIDS (sudden infant death syndrome). A meta-analytic study published by American Pediatric Association in Pediatrics in October 2005 supports this benefit to one year of age. However, other experts, while acknowledging the correlation between SIDS risk reduction and pacifier use, questioned the causality of the findings.

Some parents prefer the use of a pacifier to the child sucking their thumb or fingers.

Although some children stop sucking on pacifiers on their own between 2 and 4 years of age. However, some children continue these habits over long periods of time. In these children, the upper front teeth may tip toward the lip or not come in properly. Frequent or intense habits over a prolonged period of time can affect the way the child's teeth bite together, as well as the growth of the jaws and bones that support the teeth.

The British Dental Health Foundation recommends: "If you can, avoid using a dummy and discourage thumb sucking. These can both eventually cause problems with how the teeth grow and develop. And this may need treatment with a brace when the child gets older."

Babies need their mouths for play and exploration. By the time a child is crawling and learning to walk, pacifiers are both unhygienic and limiting. Although many experts still recommend weaning a child from pacifier use at about age two, others suggest that six to ten months is the best to end pacifier use. Before the age of two, children have short memories and may easily forget about a pacifier that has been lost for a few days. Pacifier use should not be terminated too soon or too abruptly since a baby may substitute thumb sucking or some other behavior such as hair pulling. A two-year-old is much less likely to revert to thumb sucking.

Sometimes severe stress or emotional upset causes a child to use a pacifier for a very long time. Even children who stop because of peer pressure at school may continue to use a pacifier to calm down at home or go to sleep.

If a child is using the pacifier, sooner or later it must come an end.

As many parents have discovered, saying bye-bye or firing the pacifier is something that is much easier said than done.

Four basic approaches have been utilized:

Following are techniques that have traditionally been used to put end to the use of pacifier:

Try the Slow and Steady approach

Just like any other addiction (physical or psychological), child's dependency on the pacifier may be dealt with by taking it away a little at a time. This approach might work in some toddler and it may take more time than some other methods.

Go Cold Turkey

It takes a great deal of patience and determination on parents part. Simply taking the pacifier away, and not give it back—no matter how much toddler begs, pleads, and screams for it.

Bad Taste or Smell

Using spicy or smelly materials on a pacifier. This technique is not recommended due to the fact that the toddler might have allergic reaction to the chemical and might physical and or emotional trauma.

Snip it

Snip the end of the pacifier with a pair of scissors. Then, explain that the pacifier is broken and has to be thrown away. (Don't give it back as it may cause your child to choke).

However, all of the above mentioned methods to put end to the use of pacifier are challenging to parents while unsafe and cause a great deal of anger and anxiety for the child.

SUMMARY OF THE INVENTION

Accordingly, an object of the present invention is to provide a novel pacifier structure that causes the baby to lose the desire to use a pacifier without the anger, emotional trauma or physical and chemical risks typically associated with prior art techniques utilized to wean children from pacifier use.

In accordance with the present invention, there is provided a pacifier structure which includes bristle or other safe and flexible structures protruding from the upper surface of the mouth shield and toward the direction of the baby's face when used so that the baby is discouraged from sucking on the nipple of the pacifier because of the mild irritation provided by the bristles.

DETAILED DESCRIPTION OF THE PREFERRED EMBODIMENTS

Figure 1:
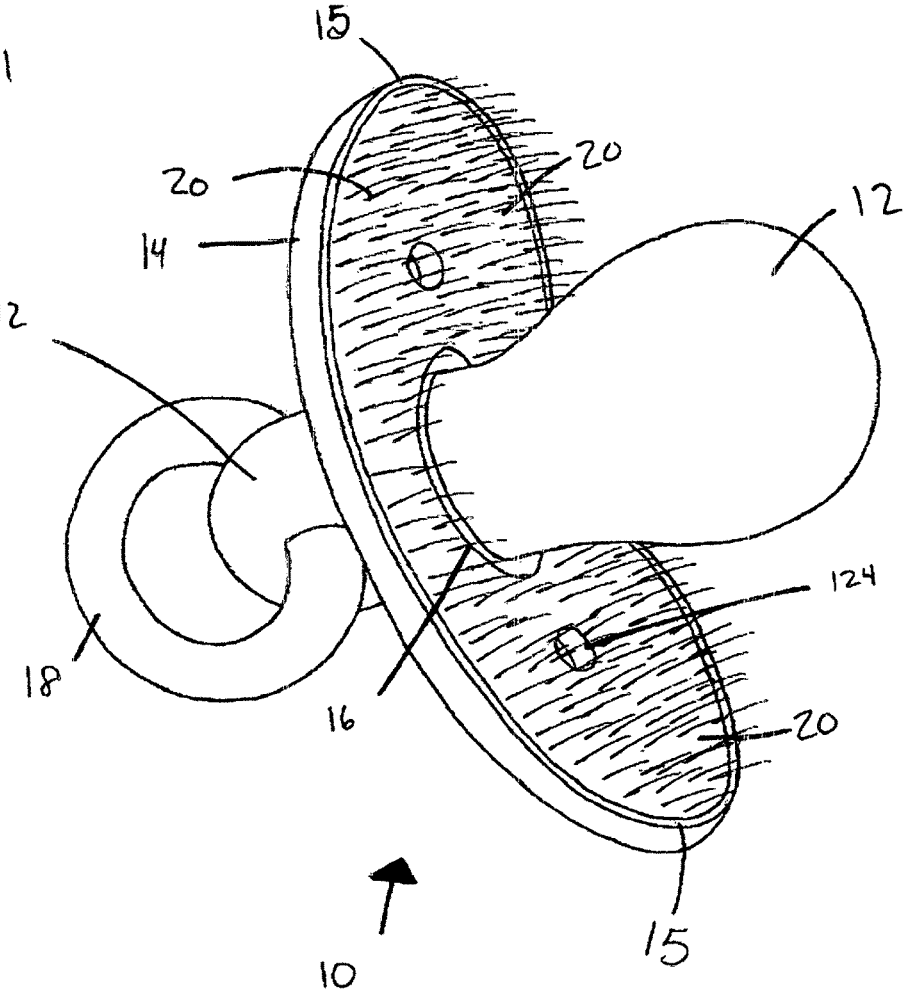
FIG. 1 is a perspective view of a pacifier in accordance with the present invention.

The present invention relates to an improved pacifier which when properly utilized will wean a child off of pacifier use without creating excessive anger, anxiety or upset. Accordingly, a pacifier in accordance with the present invention shown in FIG. 1, is generally designated as 10, is shown in perspective view. The pacifier 10 includes a teat 12, which as shown in the drawing is formed to simulate the nipple on a bottle. Those skilled in the art will understand that the form of the teat 12 can be as that shown or take the form of the mother's nipple. The form of the teat is dependent upon paternal and child preference and local custom.

Also shown in FIG. 1, the pacifier in the present invention includes mouth shield 14. The mouth shield 14, although slightly curved as shown in FIG. 1 to conform to the general contour of a baby's face, is arranged generally perpendicular to the axis of the teat 12. As can be seen from the drawing, the teat 12 extends through an aperture 16, generally centrally located in mouth shield 14, to project below the bottom surface of the mouth shield 14. The mouth shield 14 and the teat 12 are suitably affixed to each other so as to remain in stable immovable position relative to each other.

Also, as is present in many pacifiers, a handle 18 is attached to the lower end of teat 12 to prevent the baby from choking on the teat should it be dislodged from mouth shield 14. As can be seen, a suitable sturdy structure for pacifying babies is achieved in the pacifier 10 of the present invention.

Also as shown in FIG. 1, bristles 20 are affixed to the upper surface of the mouth shield so as to project along axes generally parallel with the centerline of the teat 12. The bristles 20 cover the entire upper surface of the mouth shield from an outer edge 15 to immediately adjacent to the teat 12. Arranged in this fashion, the bristles 20 serve as a mild irritant to the face and mouth of the child during utilization of the pacifier by the child and thus discourage continued use.

Figure 2:
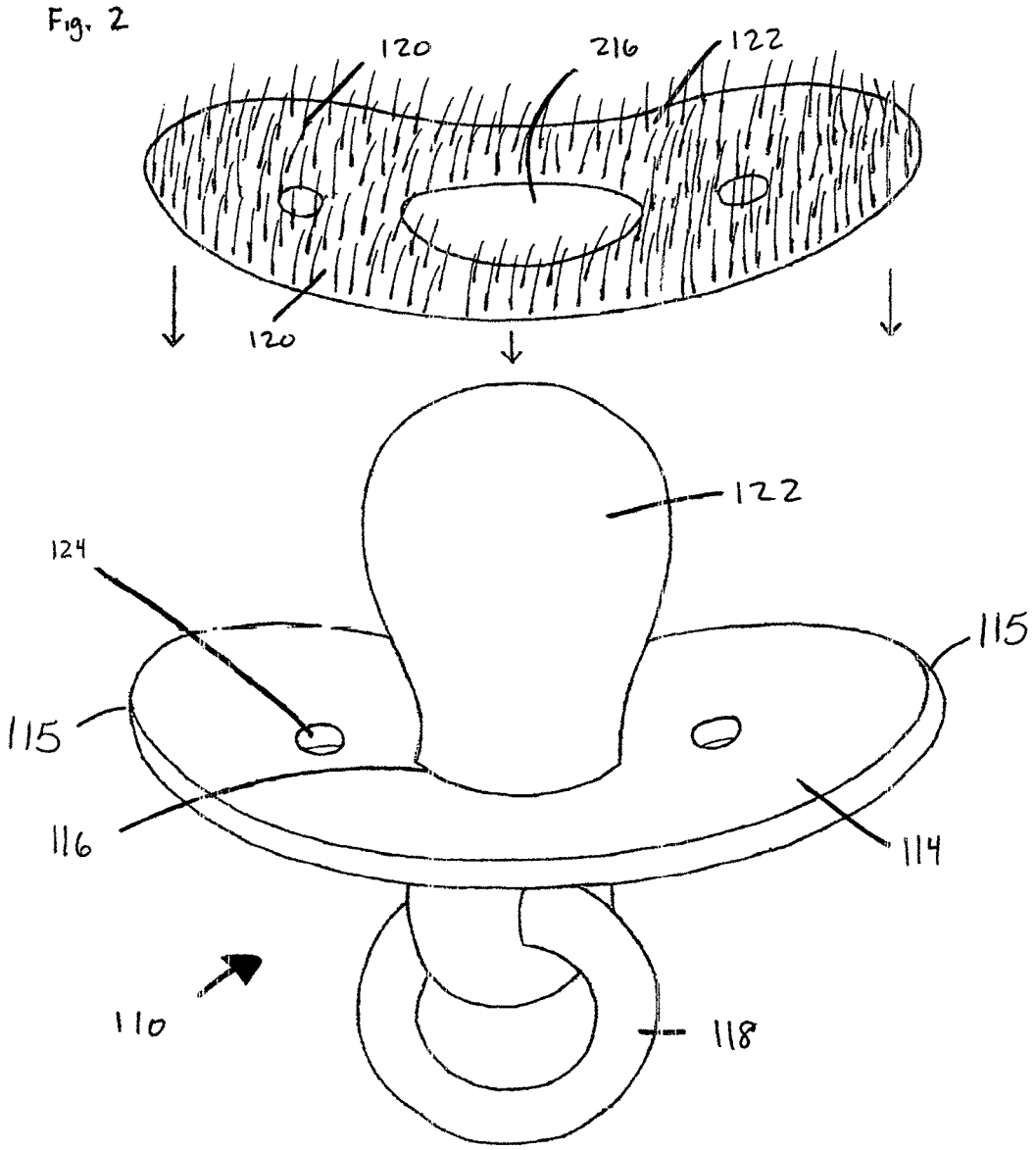
FIG. 2 is a perspective view of an alternative embodiment of a pacifier in accordance with the present invention.

FIG. 2 shows an alternative use of the present invention, where in the pacifier generally designated in 110 is shown as a standard Prior Art construction. The pacifier includes a teat 112, a mouth shield 114 and handle 118. The teat 112 projects through mouth shield 114 through aperture 116 just as in the device of FIG. 1. However, bristles 120 are fixed to a flexible sheet or applique 122 having aperture 216 centrally located in flexible sheet 122 to allow slip fit of the flexible sheet 122 over teat 112. As in the earlier embodiment, the bristles 120 cover the entire surface of the flexible sheet or applique 122, as well as, around the aperture 216. The underside of flexible sheet 122 is provided with a suitable fastener such as glue or another suitable cementing agent so that flexible sheet 122 can be affixed to the upper surface of mouth shield 114. As illustrated in FIG. 2, when the flexible sheet or applique 122 is affixed to the upper surface of the mouth shield 114, the bristles 120 cover the entire upper surface from an outer edge 115 to immediately adjacent to the teat 122.

It should be obvious that the device of FIG. 2 can be utilized as an alternative means for constructing the device of FIG. 1. The device of FIG. 2 can be sold and marketed as a two piece arrangement allowing for standard utilization of pacifier 110 until the appropriate time has arrived to wean the child from further pacifier use. At that time flexible sheet 122 can be affixed in the manner described.

Both embodiments illustrated with FIG. 1. and FIG. 2. are provided with apertures 124, intended to allow drainage of during use by the child. This provision is intended for sanitation and hygiene purposes.

While we have described in the detailed description of the preferred embodiments, the best known mode of making and practicing the present invention, nothing herein should be construed to limit the invention herein except as set forth in the following claims.

Therefore, what I claim is:

1. A pacifier, intended for use with infants of suitable age to wean a child from continued pacifier use without anger, anxiety or stress, comprising:

a) a teat structure for allowing the child to suck upon it;

b) a mouth shield arranged generally perpendicularly to the teat and joined therewith so as to be generally inseparable therefrom, said mouth shield defining an outermost edge of the pacifier, said mouth shield comprising apertures extending through said mouth shield, said apertures being disposed radially outward from the teat structure; and c) a flexible sheet having bristle structures projecting therefrom, said bristle structures covering an entire surface of said mouth shield from an outermost edge of the mouth shield to a position adjacent the teat, wherein said flexible sheet comprises apertures extending through said flexible sheet, wherein the apertures of the mouth shield are axially aligned with said apertures of the flexible sheet, wherein said bristle structures project in the same direction as the teat to slightly irritate the face and mouth of the child during use thereby discouraging continued use of the pacifier.

2. The pacifier of claim 1, wherein said bristle structures are tooth brush bristles.

3. The pacifier of claim 1, including an attached handle to prevent the teat and mouth shield from being dislodged relative to each other.

4. A pacifier, intended for use with infants of suitable age to wean a child from continued pacifier use without anger, anxiety or stress, comprising:

a) a teat structure for allowing the child to suck upon it;

b) a mouth shield arranged generally perpendicularly to the teat and joined therewith so as to be generally inseparable therefrom, said mouth shield having an outermost edge defining an outermost edge of the pacifier, said mouth shield comprising apertures extending through said mouth shield, said apertures being disposed radially outward from the teat structure; and c) a flexible sheet having bristle structures projecting from and covering an entire surface of the flexible sheet, said flexible sheet configured to cover an entire surface of the mouth shield from the outermost edge of the mouth shield to a position adjacent the teat, and d) a bonding agent on a surface of said flexible sheet opposite the surface having said bristle structures such that the flexible sheet is bondable to a surface of the mouth shield on the side of the mouth shield through which the teat projects for a child's gratification, wherein the flexible sheet comprises apertures extending through said flexible sheet, wherein the apertures of the mouth shield are axially aligned with said apertures of said flexible sheet.

5. The pacifier of claim 4, wherein the bristle structures on the flexible sheet project in the same direction as the axis of the teal when bonded to the mouth shield.

6. The pacifier of claim 5 including an attached handle to prevent the teat and mouth shield from being dislodged relative to each other.

* * * * *